US007012056B2

(12) United States Patent
Gupta

(10) Patent No.: US 7,012,056 B2
(45) Date of Patent: Mar. 14, 2006

(54) EFFERVESCENT CLEANING COMPOSITION COMPRISING SURFACTANT, BUILDER, AND DISSOLVED GAS

(75) Inventor: Neeraj Gupta, Vlaardingen (NL)

(73) Assignee: Unilever Home & Personal Care USA, Greenwich, CT (US)

( * ) Notice: Subject to any disclaimer, the term of this patent is extended or adjusted under 35 U.S.C. 154(b) by 0 days.

(21) Appl. No.: 10/823,883

(22) Filed: Apr. 14, 2004

(65) Prior Publication Data

US 2004/0209791 A1 Oct. 21, 2004

(30) Foreign Application Priority Data

Apr. 17, 2003 (EP) ..... 03252501

(51) Int. Cl.
*C11D 7/04* (2006.01)

(52) U.S. Cl. ..... 510/370; 510/276; 510/396; 510/406

(58) Field of Classification Search ..... 510/276, 510/370, 396, 406
See application file for complete search history.

(56) References Cited

U.S. PATENT DOCUMENTS

| | | | | | |
|---|---|---|---|---|---|
| 3,639,568 | A | * | 2/1972 | Schmidt | 424/43 |
| 3,947,567 | A | | 3/1976 | Berg, Jr. et al. | 424/45 |
| 4,180,467 | A | | 12/1979 | Barth | 252/99 |
| 4,219,333 | A | * | 8/1980 | Harris | 8/137 |
| 4,406,708 | A | | 9/1983 | Hesselgren | 134/37 |
| 4,436,720 | A | | 3/1984 | Pakhomov et al. | 424/44 |
| 4,592,855 | A | | 6/1986 | Gioffre et al. | 252/89.1 |
| 4,726,944 | A | * | 2/1988 | Osipow et al. | 510/120 |
| 4,772,427 | A | * | 9/1988 | Dawson et al. | 510/158 |
| 4,871,530 | A | * | 10/1989 | Grollier et al. | 424/47 |
| 5,326,556 | A | * | 7/1994 | Barnet et al. | 424/73 |
| 5,334,325 | A | * | 8/1994 | Chaussee | 424/43 |
| 5,500,211 | A | * | 3/1996 | George et al. | 424/73 |
| 5,514,302 | A | * | 5/1996 | Brown | 510/280 |
| 5,523,081 | A | * | 6/1996 | Edwards et al. | 424/73 |
| 5,602,091 | A | * | 2/1997 | Monson et al. | 510/406 |
| 5,648,326 | A | * | 7/1997 | Sramek | 510/284 |
| 5,858,343 | A | * | 1/1999 | Szymczak | 424/73 |
| 5,866,524 | A | * | 2/1999 | Wevers | 510/279 |
| 5,902,225 | A | * | 5/1999 | Monson | 516/10 |
| 5,981,459 | A | * | 11/1999 | Verbiest et al. | 510/279 |
| 6,033,647 | A | * | 3/2000 | Touzan et al. | 424/45 |
| 6,096,702 | A | * | 8/2000 | Ramirez et al. | 510/421 |
| 6,096,703 | A | | 8/2000 | Hall | 510/441 |
| 6,106,817 | A | * | 8/2000 | Ramirez et al. | 424/70.19 |
| 6,310,014 | B1 | | 10/2001 | Rau | 510/108 |
| 6,682,726 | B1 | * | 1/2004 | Marchesi et al. | 424/73 |
| 2002/0182234 | A1 | * | 12/2002 | Riedel et al. | 424/401 |

FOREIGN PATENT DOCUMENTS

| | | | |
|---|---|---|---|
| EP | 918 087 | | 5/1999 |
| EP | 936 268 | | 8/1999 |
| EP | 1 270 711 | | 1/2003 |
| EP | 1270711 | * | 1/2003 |
| WO | 86/02832 | | 5/1986 |
| WO | 90/11343 | * | 10/1990 |
| WO | 97/25408 | * | 7/1997 |
| WO | 98/04671 | | 2/1998 |
| WO | 98/35011 | | 8/1998 |
| WO | 99/64556 | | 12/1999 |
| WO | 01/12766 | | 2/2001 |

OTHER PUBLICATIONS

European Search Report in an EP application EP 03 25 2501.
Derwent Abstract of EP 918 087—published May 26, 1999.
PCT International Search Report in a PCT application PCT/EP 2004/003230.

* cited by examiner

*Primary Examiner*—Charles Boyer
(74) *Attorney, Agent, or Firm*—Rimma Mitelman

(57) ABSTRACT

The present invention provides an aqueous effervescent liquid cleaning composition which upon contact with water provides effervescent action, and which comprises at least 5% wt of a surfactant and a dissolved gas in a sufficient amount to provide the effervescent action, said gas having a higher solubility in an aqueous surfactant-containing composition than in water. It has been found that this composition is easy to produce at affordable cost and gives consumer perceivable benefits.

6 Claims, No Drawings

EFFERVESCENT CLEANING COMPOSITION COMPRISING SURFACTANT, BUILDER, AND DISSOLVED GAS

FIELD OF THE INVENTION

The present invention relates to an effervescent cleaning composition which upon contact with water provides an effervescent and cleaning effect. In particular, the invention relates to an effervescent detergent composition for use in fabric washing.

The invention also relates to a process for cleaning articles, in particular fabric articles, whereby an effervescent action is provided by employing effervescent cleaning composition of the present invention.

BACKGROUND OF THE INVENTION

The development and formulation of effervescent compositions has traditionally been focussed on the use of various constituents for obtaining in situ chemical reactions upon contact with water, so as to form a gas to provide effervescent action.

This type of acid/base reaction systems has for instance been disclosed in U.S. Pat. Nos. 4,180,467, 4,406,708, and 4,436,720. The cleansing benefit derived from the effervescent action has been well-documented in these prior art patent documents.

Furthermore, it is known in the art that effervescent action can be applied for promoting rapid release of detergents into the wash liquor so as to provide favourable cleaning performance. In this connection, several solution involving effervescent systems have been proposed to try and avoid problems of poor dissolution and dispensing behaviour.

For example, in WO-98/04671 effervescent systems for use in detergents are disclosed in which, in an effort to improve dissolution, acid and alkaline reactants which react upon contact with water to produce a gas, are mixed with a stabilising agent, so as to produce a substantially anhydrous effervescent particle for use in a washing cycle.

Similarly, WO-98/35011 discloses particles comprising sodium bicarbonate and organic acid reactants which react together and which are formed into a particle by using a binder.

Furthermore, EP-A-918,087 refers to co-builder particles for use as additive in detergent compositions, comprising bicarbonate and polycarboxylic acid which are formed by roller compaction and which contain no free moisture.

Another way of providing effervescent action is disclosed in U.S. Pat. No. 3,947,567. In this document, a method of providing an effervescent mouth wash is disclosed, wherein a liquefied gas is distributed under pressure in an aerosol dispensing container.

WO-86/02832 discloses yet another way to provide effervescence to anhydrous compositions when these are contacted with water. In this document, effervescent compositions are disclosed, comprising an essentially anhydrous base medium and inorganic oxide material containing an adsorbed gas, e.g. carbon dioxide. This gas maybe any gas capable of being adsorbed by the inorganic oxide material in sufficient amounts to provide effervescent action upon contact with water.

However, the technology applied in the above-described effervescent systems and compositions cannot be used for aqueous liquid cleaning compositions without incurring considerable problems. A main reason is that incorporation of reactants which react on contact with water to produce a gas, into such an aqueous liquid would lead to immediate reaction and that this immediate reaction can only be avoided by segregating these reactants, e.g. by encapsulating them, which would entail considerable cost. Furthermore, the technology disclosed in U.S. Pat. No. 3,947,567 and WO-86/02832 cannot be suitably used in aqueous cleaning systems.

It follows that there is still a need for providing an effervescent aqueous liquid cleaning composition especially for use in fabric washing, which produces adequate effervescent action when contacted with water and of which the manufacturing cost is moderate.

Consequently, an object of the present invention is to provide such an effervescent aqueous liquid cleaning composition.

It is another object of the invention to provide an effervescent aqueous liquid cleaning composition which is easy to produce at affordable cost and which gives a consumer perceivable benefits.

It has now surprisingly been found that these and other objects can be achieved when applying the effervescent aqueous cleaning composition of the present invention.

DEFINITION OF THE INVENTION

Accordingly, in one aspect the present invention provides an aqueous effervescent liquid cleaning composition which upon contact with water provides effervescent action, and which comprises at least 5% by weight of surfactant and dissolved gas in a sufficient amount to provide the effervescent action, said gas being present in the composition at a concentration of from 0.001 to 5% by weight and having a higher solubility in an aqueous surfactant containing composition than in water.

In another aspect the invention provides a process for cleaning articles, especially fabric articles, whereby an effervescent action is provided by employing an aqueous effervescent liquid cleaning composition according to the present invention.

DETAILED DESCRIPTION OF THE INVENTION

The present invention relates to an aqueous effervescent liquid cleaning composition which provides effervescent action when contacted with water.

Without wishing to be bound by theory, it is considered that the invention is based on the phenomenon that the solubility of certain gases in water increases when surfactant material is added to said water and the concentration of this surfactant in the water is increased. This means that higher amounts of such gases can be dissolved in aqueous liquid cleaning formulations containing at least 5% by weight of surfactant material than in water. When such an aqueous liquid cleaning formulation is poured into water to form a wash liquor, a certain amount of gas is liberated as a result of the dilution effect, i.e. the lower surfactant concentration in the wash liquor, so as to give an effervescent effect.

It has surprisingly been found that most of the dissolved gas remains in the dissolved state during storage and that the gas will only be liberated upon contact with water.

It has also been found that the aqueous effervescent cleaning composition of the invention can be prepared in a simple way and that the preparation cost is moderate.

Furthermore, no reactive ingredients need to be applied for obtaining the effervescent effect and types of dissolved gas can be used which actively contribute to the cleaning performance after addition to the wash liquor. In particular, oxygen can be used as dissolved gas which gas will generally contribute to the bleaching action when applied for washing fabrics.

Furthermore, the effervescent action of the composition of the invention in the wash liquor will not only contribute to the cleaning performance but it will also provide a consumer perceivable sensation of cleaning. Moreover, the composition of the present invention was found to provide a consumer perceivable perfume benefit. When opening a bottle containing an aqueous effervescent liquid composition of the invention, the consumer will immediately smell some of the perfume constituents contained in said liquid composition owing to the fact that some small portion of the dissolved gas will evaporate and entrain the perfume constituents.

The aqueous effervescent liquid cleaning composition of the invention contains effectively at least 10% by weight of water, the water content being preferably in the range of from 20 to 90% by weight.

This aqueous effervescent cleaning composition may generally be any aqueous liquid composition. It may be either an isotropic or a structured liquid composition and it may optionally contain suspended particles. However, the composition of the invention is preferably an isotropic liquid detergent composition for use in fabric washing.

The aqueous liquid cleaning composition is preferably maintained in a non-pressurised container, i.e. a container wherein the pressure does not exceed 50 mbarg. A suitable container may be a plastic container e.g. made of polyethylene, polypropylene, polyvinylchloride or polyethylene terephthalate.

The Dissolved Gas

The dissolved gas according to the invention has a higher solubility in an aqueous surfactant system than in water.

The dissolved gas is present in the composition of the invention in a sufficient amount to provide the effervescent action upon contact with water. The dissolved gas is present in the composition at a concentration of from 0.001 to 5% by weight, a concentration of from 0.1 to 3% by weight being preferred.

For most applicable types of gas for use as dissolved gas, the dissolved state of these gases in a medium (i.e. water or the composition of the present invention) is defined in terms of the absence of chemical interaction with constituents of said medium.

Carbon dioxide is an exception, since this type of gas dissolves in water by reacting with it so as to form carbonic acid. For the other suitable gases known and tested, the solubility in water is mainly due to physical interactions and the above definition is correct.

The increase in solubility of a suitable gas when the surfactant concentration is raised, is believed to be primarily due to solubilisation of the gas in the micellar system of the surfactant material.

The dissolved gas according to the invention may desirably be an inorganic gas selected from the group consisting of nitrogen, oxygen, carbon dioxide, oxides of nitrogen (nitrous oxide, nitrogen oxide), and noble gases, particularly helium and argon.

For cost and safety reasons, most suitable inorganic gases for use as dissolved gas are nitrogen, carbon dioxide and a combination thereof.

Alternatively, the dissolved gas may effectively be an organic gas selected from $C_1$–$C_4$ lower hydrocarbons. These organic gases may be branched or not branched. Typical examples of such hydrocarbons are methane, ethane and propane and iso-propane.

As mentioned above, when oxygen is used as dissolved gas in a composition of the invention for use in fabric washing, it will generally contribute to not only the effervescent action but also the bleaching action of said composition.

On the other hand, the effervescent action of the composition of the invention could also be suitably used to remove oxygen from said composition in order to stop oxidative reactions during the cleaning process.

Since some of the dissolved gas may evaporate during storage, it is desirable to use non-permeable packaging material and air tight bottles for the liquid composition of the invention. For the same reason, it is desirable to use a gas which is heavier than air as dissolved gas, in order to keep most of it in the air tight bottle after it has been opened.

The Surfactant

The surfactant is present in the composition of the invention at a concentration of at least 5% by weight, preferably from 5 to 70% by weight, a concentration of 10 to 50% by weight being more preferred.

The surfactant may generally be any type of surfactant, such as a nonionic, an anionic, a cationic, or a zwitterionic surfactant. Combinations of surfactant are also suitable for use in the composition of the present invention. Preferred types of surfactant are anionic, nonionic and cationic surfactants.

Anionic Surfactant

The anionic surfactant that may be used, is preferably selected from the group consisting of linear alkyl benzene sulphonates, alkyl sulphonates, alkyl polyether sulphates, alkyl sulphates and mixtures thereof.

The linear alkyl benzene sulphonate (LAS) materials and their preparation are described for example in U.S. Pat. Nos. 2,220,099 and 2,477,383, incorporated herein by reference. Particularly preferred are the sodium, potassium and mono-, di-, or tri-ethanolamminium linear straight chain alkylbenzene sulphonates in which the average number of carbon atoms in the alkyl group is from 11 to 14. Sodium salt of $C_{11}$–$C_{14}$, e.g. $C_{12}$, LAS is especially preferred.

Preferred anionic surfactants also include the alkyl sulphate surfactants being water soluble salts or acids of the formula $ROSO_3M$, wherein R preferably is a $C_{10}$–$C_{24}$ hydrocarbyl, preferably an alkyl or hydroxyalkyl having a $C_{10}$–$C_{18}$ alkyl group, more preferably a $C_{12}$–$C_{15}$ alkyl or hydroxyalkyl, and wherein M is H or a cation, e.g. an alkali metal cation (e.g. sodium, potassium, lithium), or ammonium or substituted ammonium, especially mono-, di-, or tri-ethanolammonium. Most preferably, M is sodium.

Further preferred anionic surfactants are alkyl sulphonates, and desirably those in which the alkyl groups contain 8 to 26 carbon atoms, preferably 12 to 22 carbon atoms, and more preferably 14 to 18 carbon atoms.

The alkyl substituent is preferably linear, i.e. normal alkyl, however, branched chain alkyl sulphonates can be employed, although they are not as good with respect to biodegradability.

The alkyl substituent may also be terminally sulphonated or may be joined to any carbon atom on the alkyl chain, i.e. may be a secondary sulphonate. The alkyl sulphonates can be used as the alkali metal salts, such as sodium and potassium. The preferred salts are the sodium salts. The preferred alkyl sulphonates are the $C_{10}$ to $C_{18}$ primary normal alkyl sodium sulphonates.

Also, alkyl polyether sulphates are preferred anionic surfactants for use in the composition of the invention. These polyether sulphatesmay be normal or branched chain alkyl and contain lower alkoxy groups which can contain two or three carbon atoms. The normal alkyl polyether sulphates are preferred in that they have a higher degree of biodegradability than the branched chain alkyl, and the alkoxy groups are preferably alkoxy groups.

The preferred alkyl polyethoxy sulphates used in accordance with the present invention are represented by the formula:

$$R_1—O(CH_2CH_2O)_p—SO_3M,$$

wherein:

R1 is $C_8$ to $C_{20}$ alkyl, preferably $C_{12}$ to $C_{15}$ alkyl;

p is 2 to 8, preferably 2 to 6, and more preferably 2 to 4; and

M is an alkali metal, such as sodium and potassium, or an ammonium cation. The sodium salt is preferred.

The surfactant for use in the composition of the invention may also be a fatty acid or a fatty acid soap.

The fatty acids include saturated and non-saturated fatty acids obtained from natural sources and synthetically prepared. Examples of fatty acids include capric, lauric, myristic, palmitic, stearic, oleic, linoleic and linolenic acid.

Nonionic Surfactant

The surfactant material in the effervescent liquid composition of the invention may also be a nonionic surfactant.

Nonionic detergent surfactants are well-known in the art. They normally consist of a water-solubilizing polyalkoxylene or a mono- or d-alkanolamide group in chemical combination with an organic hydrophobic group derived, for example, from alkylphenols in which the alkyl group contains from about 6 to about 12 carbon atoms, dialkylphenols in which primary, secondary or tertiary aliphatic alcohols (or alkyl-capped derivatives thereof), preferably having from 8 to 20 carbon atoms, monocarboxylic acids having from 10 to about 24 carbon atoms in the alkyl group and polyoxypropylene. Also common are fatty acid mono- and dialkanolamides in which the alkyl group of the fatty acidradical contains from 10 to about 20 carbon atoms and the alkyloyl group having from 1 to 3 carbon atoms. In any of the mono- and di-alkanolamide derivatives, optionally, there may be a polyoxyalkylene moiety joining the latter groups and the hydrophobic part of the molecule. In all polyalkoxylene-containing surfactants, the polyalkoxylene moiety preferably consists of from 2 to 20 groups of ethylene oxide or of ethylene oxide and propylene oxide groups. Amongst the latter class, particularly preferred are those described in European specification EP-A-225,654. Also preferred are those ethoxylated nonionics which are the condensation products of fatty alcohols with from 9 to 15 carbon atoms condensed with from 3 to 11 moles of ethylene oxide. Examples of these are the condensation products of $C_{11-13}$ alcohols with (say) 3 or 7 moles of ethylene oxide.

Builders

Builders which can be used in the composition according to the present invention include conventional alkaline detergent builders, inorganic or organic, which can be used at levels of from 0% to 50% by weight of the composition, preferably from 1% to 35% by weight.

Examples of suitable inorganic detergency builders that may be used are water soluble alkali metal phosphates, polyphosphates, borates, silicates, and also carbonates. Specific examples of such builders are sodium and potassium triphosphates, pyrophosphates, orthophosphates, hexametaphosphates, tetraborates, silicates, and carbonates.

Examples of suitable organic detergency builders are: (1) water-soluble amino polycarboxylates, e.g. sodium and potassium ethylenediaminetetraacetates, nitrilotriacetates and N-(2 hydroxyethyl)-nitrilodiacetates; (2) water-soluble salts of phytic acid, e.g. sodium and potassium phytates; (3) water-soluble polyphosphonates, including specifically sodium and potassium salts of ethane-1-hydroxy-1,1-diphosphonic acid; sodium and potassium salts of methylene diphosphonic acid; sodium and potassium salts of ethylene diphosphonic acid; and sodium and potassium salts of ethane-1,1,2-triphosphonic acid.

In addition, polycarboxylate builders can be used satisfactorily, including water-soluble salts of mellitic acid, citric acid, and carboxymethyloxysuccinic acid, salts of polymers of itaconic acid and maleic acid, tartrate monosuccinate, and tartrate disuccinate.

Desirably, the detergency builder is selected from the group consisting of carboxylates, polycarboxylates, aminocarboxylates, carbonates, bicarbonates, phosphates, phosphonates and mixtures thereof.

Amorphous and crystalline zeolites or aluminosilicates can also be suitably used as detergency builder in the effervescent composition of the invention.

Enzymes

When the composition of the invention is used for fabric washing, it may suitably contain enzymes.

Suitable enzymes for use in the present invention include proteases, amylases, lipases, cellulases, peroxidases, and mixtures thereof, of any suitable origin, such as vegetable, animal bacterial, fungal and yeast origin. Preferred selections are influenced by factors such as pH-activity, thermostability, and stability to active bleach detergents, builders and the like. In this respect bacterial and fungal enzymes are preferred such as bacterial proteases and fungal cellulases.

Enzymes are normally incorporated into detergent composition at levels sufficient to provide a "cleaning-effective amount". The term "cleaning effective amount" refers to any amount capable of producing a cleaning, stain removal, soil removal, whitening, or freshness improving effect on the treated substrate. In practical terms for normal commercial operations, typical amounts are up to about 5 mg by weight, more typically 0.01 mg to 3 mg, of active enzyme per gram of detergent composition.

Stated otherwise, the composition of the invention may typically comprise from 0.001 to 5%, preferably from 0.01 to 1% by weight of a commercial enzyme preparation.

Other Optional Components

Alkaline buffers may be optionally added to the composition of the invention, including monethanolamine, triethanolamine, borax, and the like.

As another optional ingredient, an organic solvent may suitably be present in the effervescent composition of the invention, preferably at a concentration of up to 10% by weight.

There may also be included in the formulation, minor amounts of soil suspending or anti-redeposition agents, e.g. polyvinyl alcohol, fatty amides, sodium carboxymethyl cellulose or hydroxy-propyl methyl cellulose.

Optical brighteners for cotton, polyamide and polyester fabrics, and anti-foam agents may also be used.

Other optional ingredients which may be added in minor amounts, are soil release polymers, dye transfer inhibitors, polymeric dispersing agents, suds suppressors, dyes, perfumes, colourants, filler salts, antifading agents and mixtures thereof.

Preparation Method

The effervescent liquid composition of the invention may be effectively prepared by carrying out the following steps:

(i) mixing together all the liquid and, optionally, solid ingredients of the liquid composition, and (ii) incorporating a gas into this liquid by (a) contacting the liquid with said gas under constant pressure in a closed mixing vessel while stirring the liquid, during or after preparation of said; or (b) incorporating the gas by purging it into the liquid at constant pressure and temperature.

In step (ii)(a), the rate of gas incorporation into the liquid can be increased by increasing the pressure of the gas and/or by lowering the temperature of the liquid.

On the other hand, step (ii)(b) can be effectively carried out either in a mixing vessel during or after the preparation of the liquid, or by applying an in-line dosing method.

The invention will now be illustrated with reference to the following example, in which parts and percentages are by weight.

EXAMPLE 1

An aqueous effervescent liquid detergent formulation was prepared having the following composition:

| Ingredient | % wt |
|---|---|
| Nonionic surfactant | 12.0 |
| Fatty acid | 8.0 |
| SLES 3EO | 12.0 |
| Propylene glycol | 4.0 |
| Sodium hydroxide | 2.0 |
| Sodium chloride | 2.0 |
| Boric acid | 1.0 |
| Phosphonate | 1.0 |
| Minors (including perfume, dye, PVP, fluorescer, preservative) | 0.9 |
| Carbon dioxide gas | 0.5 |
| Water | 56.6 |

The carbon dioxide gas was incorporated into this effervescent composition using the above-described preparation method, particularly the method outlined under (ii) (b), i.e. by contacting the liquid with the carbon dioxide gas at constant temperature and pressure.

This formulation showed favourable visual appearance of effervescence when contacted with excess water.

What is claimed is:

1. An aqueous effervescent liquid cleaning composition for use in fabric washing which upon contact with wash liquor provides effervescent action, and which comprises from 10 to 50% of a surfactant, from 1 to 35% of a builder, selected from the group consisting of water soluble alkali metal phosphates, polyphosphates, borates, silicates, carbonates; polycarboxylates; water-soluble salts of phytic acid; water-soluble polyphosphonates; water-soluble salts of mellitic acid; carboxymethyloxysuccinic acid, salts of polymers of itaconic acid and maleic acid, tartrate monsuccinate, and tartrate disuccinate; amorphous and crystalline zeolites or aluminosilicates and a dissolved gas in a sufficient amount to provide the effervescent action, wherein the dissolved gas is an inorganic gas selected from the group consisting of nitrogen, oxygen, carbon dioxide, oxides of nitrogen and noble gases and is present in the composition at a concentration of from 0.001 to 5% by weight and having a higher solubility in an aqueous surfactant-containing composition than in water, wherein said composition is maintained in a non-pressurized container.

2. A composition according to claim 1, wherein the dissolved gas is selected from nitrogen and carbon dioxide.

3. A composition according to claim 1, wherein the dissolved gas is present at a concentration of from 0.1 to 3% by weight.

4. A composition according to claim 1, wherein the surfactant is selected from the group consisting of nonionic, anionic, zwitterionic, and cationic surfactants and combinations thereof.

5. Composition according to claim 1, being an isotropic or structured liquid detergent composition.

6. Fabric washing process for cleaning articles, whereby an effervescent action is provided by employing an aqueous effervescent liquid cleaning composition according to claim 1.

* * * * *